US012163389B2

(12) United States Patent
Wardley et al.

(10) Patent No.: US 12,163,389 B2
(45) Date of Patent: Dec. 10, 2024

(54) RELATING TO WELL ABANDONMENT AND SLOT RECOVERY

(71) Applicant: Ardyne Holdings Limited, Aberdeen (GB)

(72) Inventors: Michael Wardley, Aberdeen (GB); George Telfer, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 595 days.

(21) Appl. No.: 17/427,631

(22) PCT Filed: Feb. 6, 2020

(86) PCT No.: PCT/EP2020/052969

§ 371 (c)(1),
(2) Date: Jul. 31, 2021

(87) PCT Pub. No.: WO2020/161227

PCT Pub. Date: Aug. 13, 2020

(65) Prior Publication Data

US 2022/0098945 A1 Mar. 31, 2022

(30) Foreign Application Priority Data

Feb. 7, 2019 (GB) ..... 1901716
Nov. 28, 2019 (GB) ..... 1917316

(51) Int. Cl.
*E21B 23/04* (2006.01)
*E21B 23/00* (2006.01)
(Continued)

(52) U.S. Cl.
CPC ..... *E21B 23/0413* (2020.05); *E21B 23/01* (2013.01); *E21B 34/142* (2020.05); *E21B 23/006* (2013.01); *E21B 29/005* (2013.01)

(58) Field of Classification Search
CPC .... E21B 23/0413; E21B 34/142; E21B 23/01; E21B 23/006; E21B 29/005
See application file for complete search history.

(56) References Cited

U.S. PATENT DOCUMENTS 5,101,895 A * 4/1992 Gilbert ..... E21B 23/006 294/86.34
8,365,826 B2 * 2/2013 Braddick ..... E21B 31/00 166/99

(Continued)

FOREIGN PATENT DOCUMENTS

GB 2309470 A 7/1997
GB 2389608 1/2005

(Continued)

OTHER PUBLICATIONS

Intellectual Property Office of the UK Patent Office; Search Report for GB1901716.9; five pages; Jun. 18, 2019; Intellectual Property Office of the UK Patent Office, Newport, South Wales, United Kingdom.

(Continued)

*Primary Examiner* — Robert E Fuller
*Assistant Examiner* — Neel Girish Patel
(74) *Attorney, Agent, or Firm* — LAW OFFICE OF JESSE D. LAMBERT, LLC

(57) ABSTRACT

A resettable mechanism and a method of controlled actuation of a hydraulically operated downhole tool to allow selective operation of the downhole tool in a wellbore. The resettable mechanism provides an inner sleeve member which is longitudinally moveable between a first and second position which opens and closes a fluid pathway to at least one actuation port on the downhole tool. Movement of the inner sleeve member is controlled via an indexing mechanism operated by drop balls. An embodiment of a casing recovery system is described mechanism operated wherein a (Continued)

downhole pulling tool is selectively actuated so as to prevent operation of the pulling tool while a hydraulically operated casing cutter is cutting casing.

19 Claims, 2 Drawing Sheets

(51) Int. Cl.

| | |
|---|---|
| ***E21B 23/01*** | (2006.01) |
| ***E21B 29/00*** | (2006.01) |
| ***E21B 34/14*** | (2006.01) |

(56) References Cited

U.S. PATENT DOCUMENTS

| | | | | |
|---|---|---|---|---|
| 10,392,901 | B2 | 8/2019 | Evertsen | |
| 2006/0243455 | A1* | 11/2006 | Telfer | E21B 21/103 166/318 |
| 2011/0048704 | A1 | 3/2011 | Clem et al. | |
| 2012/0055684 | A1 | 3/2012 | Zimmerman et al. | |
| 2013/0048273 | A1* | 2/2013 | Crow | E21B 29/002 166/237 |
| 2014/0138101 | A1* | 5/2014 | Arabsky | E21B 33/12 166/387 |
| 2016/0032697 | A1* | 2/2016 | Harris | E21B 34/06 166/381 |
| 2019/0162046 | A1 | 5/2019 | Engevik et al. | |

FOREIGN PATENT DOCUMENTS

| | | | |
|---|---|---|---|
| GB | 2562089 | A | 11/2018 |
| WO | WO 00/6879 | A1 | 11/2000 |
| WO | WO 2017/046613 | A1 | 3/2017 |
| WO | WO 2018/083473 | A1 | 5/2018 |

OTHER PUBLICATIONS

Intellectual Property Office of the UK Patent Office; Search Report for GB1917316.0; two pages; Apr. 23, 2020; Intellectual Property Office of the UK Patent Office, Newport, South Wales, United Kingdom.

European Patent Office as ISA, International Search Report for PCT/EP2020/052969; Apr. 20, 2020; eleven pages; European Patent Office, Rijswijk, The Netherlands.

* cited by examiner

RELATING TO WELL ABANDONMENT AND SLOT RECOVERY

The present invention relates to methods and apparatus for well abandonment and slot recovery and in particular, though not exclusively, to a method and apparatus for casing recovery.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. Current techniques to achieve this may require multiple trips into the well, for example: to set a bridge plug to support cement; to create a cement plug in the casing; to cut the casing above the cement plug; and to pull the casing from the well. A further trip can then be made to cement across to the well bore wall. The cement or other suitable plugging material forms a permanent barrier to meet the legislative requirements.

Each trip into a well takes substantial time and consequently significant costs. Combined casing cutting and pulling tools have been developed so that the cutting and pulling can be achieved on a single trip. Such a tool is the TRIDENT® System to Ardyne Technologies Limited, UK.

WO2017046613 describes a cutting and pulling tool which advantageously has a cutting tool which can be operated by rotation of the work string while the pulling tool is anchored to the inside wall of the casing section above the cut to hold the casing in tension and provide stability to the cutting action. The pulling tool may be considered as an anchor or spear.

The casing is cut and pulled in sections to a desired depth and if one can pull long lengths of cut casing from the well this further reduces the number of trips required to achieve casing recovery. However, it is known that the presence of drilling fluid sediments, partial cement, sand, or other settled solids in the annulus between the outside of the casing and the inside of a surrounding outer casing can act as a binding material limiting the ability to free the casing when pulled.

Traditionally, cut casing is pulled by anchoring a casing spear to its upper end and using an elevator/top drive on a drilling rig. However, some drilling rigs have limited pulling capacity, and a substantial amount of power is lost to friction in the drill string between the top drive and the casing spear, leaving insufficient power at the spear to recover the casing. Consequently, further trips must be made into the well to cut the casing into shorter lengths for multi-trip recovery.

To increase the pulling capability, a downhole power tool (DHPT) available from Ardyne Technologies Limited, UK, has been developed. After the casing has been located and engaged with a casing spear, hydraulically-set mechanically releasable slips anchor the DHPT to the wall of the larger outer casing above. A static pressure is applied to begin the upward zo movement of the cut casing, with the DHPT downhole multi-stage hydraulic actuator functioning as a hydraulic jack. After the stroke is completed, the anchors are released. The power section can be reset and the anchor re-engaged as many times as required. The DHPT is described in U.S. Pat. No. 8,365,826 to the present Applicants, the disclosure of which is incorporated herein in its entirety by reference.

The combination of a cutting and pulling tool with a hydraulic jack is provided in the TITAN® system available from Ardyne Technologies Ltd, UK and described in WO2018083473, the disclosure of which is incorporated herein in its entirety by reference.

A combined cutting and pulling tool with a hydraulic jack is also disclosed in US 2019/0162046 to Baker Hughes, a GE company, LLC, the disclosure of which is incorporated herein in its entirety by reference. The hydraulic jack is provided in the MASTODON hydraulic pulling tool available from BHGE, USA. This hydraulic pulling tool operates in a similar fashion to the DHPT with an anchor operated by fluid pressure in the work string to brace the jack. Fluid also acts on a stack of pistons to telescope the jack and decrease its length while applying an uphole tensile force on a cut section of casing attached below the jack.

All the known hydraulic jacks use an increase in fluid pressure in the throughbore of the work string to which they are attached, to operate the anchor mechanism and to move the lower end of the jack which pulls upward on a cut section of casing or other object stuck in a well.

Known cutting and pulling tools are also hydraulically operated. There is thus a known disadvantage in operating a hydraulic jack and a hydraulic casing cutting and pulling tool on the same work string. When fluid flows through the string to operate the casing cutter, the hydraulic jack will also operate.

It is therefore an object of the present invention to provide a resettable mechanism to allow selective operation of a hydraulically operated downhole tool in a tubular string.

It is a further object of at least one embodiment of the present invention to provide a downhole casing recovery system in which the hydraulic jack is selectively operable.

According to first aspect of the present invention there is provided a resettable mechanism to allow selective actuation of a hydraulically operated downhole tool in a tubular string, the hydraulically operated downhole tool including at least one actuation port through a side wall of a central bore of the downhole tool through which fluid from a throughbore of the tubular string passes to actuate the downhole tool, comprising:

an inner sleeve member, the inner sleeve member located in the central bore and being moveable relative to the downhole tool between a first position closing the at least one actuation port and a second position at which the at least one actuation port is open to provide fluid communication between the throughbore and the downhole tool; and an indexing mechanism coupling the inner sleeve member to the downhole tool to permit the inner sleeve member to be selectively moved between the first position and the second position and to maintain the inner sleeve member in the first or second position.

In this way, the fluid flow from the throughbore is selectively permitted to flow through the actuation port(s) and thus the downhole tool can be selectively operated.

Preferably, the indexing mechanism comprises a groove arranged circumferentially on an outer surface of the inner sleeve member, the groove is continuous and provides a plurality of sequential indexing positions, the indexing positions determining the extent of longitudinal travel of the inner sleeve member when the inner sleeve member rotates in the central bore relative to a cooperating index pin located in the groove. More preferably, the inner sleeve is biased in a first longitudinal direction. In this way, the index pin can be held in pockets created by the groove. When the index pin is biased to sit in the pockets, the inner sleeve member is held in the first or second position dependent upon the respective pockets position on the inner sleeve member. In this way, sequential open and closed pocket positions are arranged in the groove so that the tool can selectively be operated between open and closed configurations.

Preferably, the inner sleeve member includes a ball seat. In this way, by dropping a ball into the throughbore, the inner sleeve member can be moved by pressure building up on the dropped ball when seated in the ball seat. Preferably, movement of the inner sleeve member by force upon the ball seat moves the inner sleeve member against the bias of the indexing mechanism. Preferably, the ball is releasable from the ball seat. In this way, the inner sleeve member can rotate to move between the first and second positions and the action can be repeated. In an lo embodiment, the drop ball is of a deformable material which changes shape under pressure to fall through the ball seat when sufficient fluid pressure is applied to the drop ball when in the ball seat. In an alternative embodiment, the ball seat is deformable. In this way, heavy metal drop balls can be used which are more reliably pumped through the string to the ball seat.

Preferably, the resettable mechanism includes a ball catcher. In this way, the expelled dropped balls are collected and prevented from interfering with any other tools located further along the string.

Preferably, the inner sleeve member comprises at least one access port, the at least one access port arranged through a wall of the inner sleeve member to co-locate with the at least one actuation port when the inner sleeve member is in the second position.

Preferably, the resettable mechanism includes an intermediate sleeve, the intermediate sleeve is arranged between the inner sleeve member and the side wall of the downhole tool. Preferably, the intermediate sleeve is engaged to the side wall at each end thereof to provide an annular chamber between the intermediate sleeve and the side wall. Preferably the intermediate sleeve has a length greater than a distance over which the at least one actuation port is arranged on the down hole tool. In this way, the at least one actuation port is accessed from the annular chamber and thus multiple actuation ports may all be operated together.

Preferably the intermediate sleeve includes one or more intermediary ports, the one or more intermediary ports co-locating with the at least one access port arranged on the inner sleeve member. In this way, a smaller number of access ports than there are actuation ports can be used. Additionally, the location of the actuation ports does not require to be known for the construction of the resettable mechanism, only the diameter of the central bore and the length over which the actuation ports are located. In this way, the resettable mechanism can be arranged on a sub which is connectable to the downhole tool in a tool string.

In an embodiment, the resettable mechanism comprises: a cylindrical body having first and second ends connectable in a work string, with the second end configured for connection to the downhole tool; the body has an axial bore in which is located the intermediary sleeve and inner sleeve member as described above; the intermediary sleeve is attached to the cylindrical body towards the first end and extends out from the second end so that when the resettable mechanism is attached to the downhole tool, the intermediary sleeve enters the central bore and an end of the intermediary sleeve includes a seal which seals against the side wall of the downhole tool below the actuation port(s).

In this way, the resettable mechanism can be used with any downhole tool without requiring modification to the downhole tool itself.

Preferably, the downhole tool is an anchor. The anchor may comprise a plurality of anchoring elements having surfaces adapted to grip a tubular surface when contacted thereupon. Preferably the anchoring elements are moved radially outwards upon action of hydraulic fluid against a surface thereof. The anchoring elements may be made to move along a longitudinally arranged wedge on an anchor body so that they act as slips to move longitudinally and radially to contact the tubular surface. Alternatively, the fluid acts against an inner surface and the anchoring elements move only radially with respect to an anchor body to grip the tubular surface.

Preferably, the downhole tool is a hydraulic jack. More preferably the hydraulic jack is a downhole pulling tool comprising an anchor mechanism and a jacking mechanism. The anchor mechanism may be an anchor as lo described hereinbefore. Preferably, the jacking mechanism comprises a plurality of stacked pistons, which when actuated by fluid pressure telescope the jack so as to decrease the length and apply an upward force on a downhole object connected the jack. The resettable mechanism may be arranged to selectively actuate the anchor mechanism independently of the jacking mechanism. More preferably, the resettable mechanism selectively operates both the anchor mechanism and jacking mechanism together. In this way, the hydraulic jack can be selectively operated by dropping balls through the string.

More preferably, there is provided a second downhole tool, the second downhole tool also being a hydraulically operated downhole tool. In this way, the second downhole tool can be operated by fluid flow through the string to which the tools are attached without the first downhole tool operating. The second downhole tool may be a casing cutter. More preferably, the second downhole tool is a casing cutting and pulling tool. This provides a downhole casing recovery system in which the hydraulic jack is selectively operable. The second downhole tool may include a second resettable mechanism, the second resettable mechanism being operated by a drop ball of smaller diameter than the drop ball of the first resettable mechanism. In this way, each downhole tool can be individually selected to operate.

According to a second aspect of the present invention there is provided a method of controlled actuation of a hydraulically operated downhole tool in a tubular string, comprising the steps:

(a) mounting the hydraulically operated downhole tool in the tubular string with a resettable mechanism to selectively open and close at least one actuation port in the downhole tool;
(b) running the tubular string in a well bore;
(c) pumping fluid from surface down a throughbore of the tubular string while maintaining the resettable mechanism in a closed configuration;
(d) resetting the resettable mechanism to an open position and providing fluid communication between the throughbore and the downhole tool through the at least one actuation port; and
(e) hydraulically operating the downhole tool.

In this way, a hydraulically operated downhole tool can be selectively operated in a well. The hydraulically operated downhole tool can be effectively switched on and off in the well bore, independently of the pump rate of fluid through the string. Additionally, the hydraulically operated downhole tool can be prevented from prematurely operating when other tools on the tubular string are operating in the well bore.

Preferably the steps comprise:

(a) mounting the hydraulically operated downhole tool in the tubular string with a resettable mechanism according to the first aspect in the downhole tool;
(b) running the tubular string in a well bore with the resettable mechanism in the first position;

(c) pumping fluid from surface down the throughbore of the tubular string while maintaining the resettable mechanism in the first configuration;

(d) moving the inner sleeve member between the first position and the second position via the indexing mechanism to provide fluid communication between the throughbore and the downhole tool through the at least one actuation port;

(e) hydraulically operating the downhole tool; and (f) moving the inner sleeve member from the second position to the first position via the indexing mechanism to close the at least one actuation port and prevent operation of the hydraulically operated downhole tool.

Preferably, the method comprises repeating steps (d) to (f) to cycle operation of the hydraulically operated downhole tool.

Preferably, steps (d) and (f) comprise dropping a ball down the throughbore of the tubular string to seat in a ball seat of the inner sleeve member and by the build-up of fluid pressure on the ball, moving the inner sleeve member against a bias.

Preferably, the ball is released from the ball seat and is collected at a ball catcher in the tool. The ball may deform under pressure to pass through the ball seat or the ball may cause a deformable ball seat to deform to allow passage of the ball. Preferably, on the ball passing through the ball seat, the inner sleeve member is biased to the next position.

Preferably, the downhole tool is a hydraulic jack being part of a downhole pulling tool. At step (e) an anchor mechanism of the downhole pulling tool may engage a casing in the wellbore. At step (e) the jack may operate to telescope, decreasing in length and applying an upward force to a downhole object connected to the jack.

Preferably there is a second hydraulically operated downhole tool located on the string and the method includes at step (c) operating the second hydraulically operated downhole tool in the wellbore while maintaining the first hydraulically operated downhole tool in the first position. In this way, a further tool can be operated without the downhole tool with the resettable mechanism from operating.

Preferably, the second downhole tool is a casing cutter. The casing cutter may operate by fluid acting on a piston which pushes blades radially outwards from a tool body to contact casing to be cut. The casing cutter is preferably rotated to cut the casing with the blades. Rotation may be by rotation of the tubular string from surface or via a motor in the tubular string.

A casing spear may also be present in the tubular string. In this way, the casing cutter and casing spear may be considered as a casing cutting and pulling tool. Preferably, the hydraulic pulling tool with the resettable mechanism and the casing cutting and pulling tool together provide a downhole casing recovery system. Preferably at step (a) the downhole casing recovery system is mounted in the tubular string with the resettable mechanism in the first position. Preferably, at step (c) the casing cutter is used hydraulically to cut a section of casing and the casing spear engages the cut section of casing. Preferably, the casing spear engages the casing before the cut is made. In this way, the casing spear can be used to stabilise the cutter during the cut.

Preferably, the cut section of casing is removed from the well by engagement to the casing spear and use of the hydraulic jack. Optionally, an anchor mechanism of the hydraulic jack may be operated to engage an outer casing while the casing cutter is used hydraulically to cut a section of inner casing. The casing spear may optionally engage the inner casing when the casing cutter is used hydraulically to cut a section of inner casing. After the cut is made, the cut section of casing is attached to the casing spear and the casing spear is jacked upwards by use of the hydraulic jack, at step (e).

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figures 1, 2:
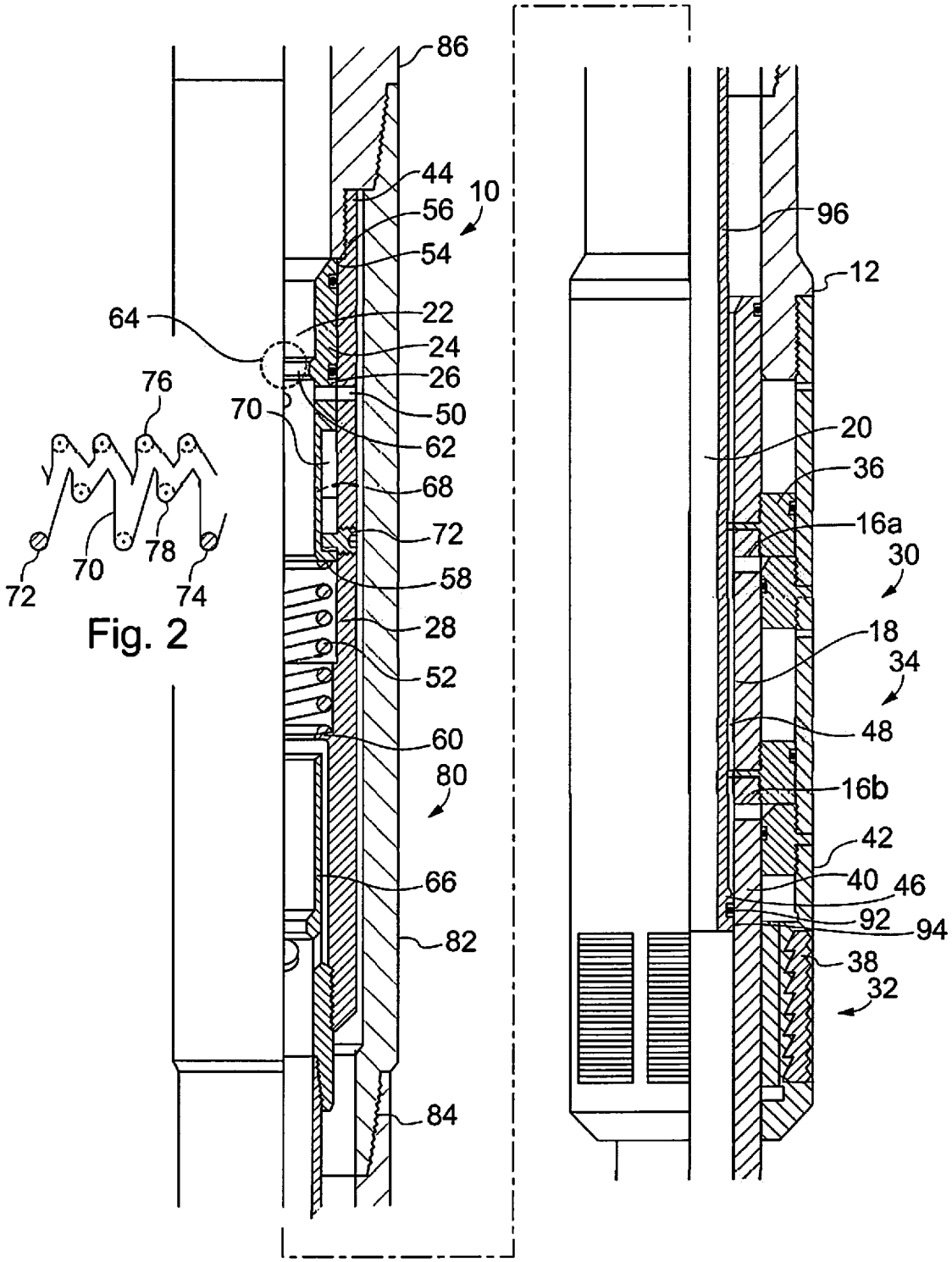
FIG. 1 is an illustration of a resettable mechanism with a hydraulically operated downhole tool according to an embodiment of the present invention.
FIG. 2 is an illustration of a groove pattern of an indexing mechanism within the resettable mechanism of FIG. 1.

Referring initially to FIG. 1 of the drawings there is illustrated a resettable mechanism, generally indicated by reference numeral 10, to allow selective actuation of a hydraulically operated downhole tool 12 according to an embodiment of the present invention.

The hydraulically operated downhole tool 12 is located in a tubular string 14 having a throughbore 22, which allows the passage of fluid from a surface downhole to actuate the downhole tool 12. The downhole tool has one or more actuation ports (two shown) 16*a,b* through a side wall 18 of a central bore 20 of the downhole tool 12, through which fluid from the throughbore 22 of the tubular string 14 passes to actuate the downhole tool 12. Fluid is typically delivered from surface down the throughbore 22 of the tubular string 14.

The hydraulically operated downhole tool 12 is shown as a hydraulic jack 30, with an anchor mechanism 32 and a jacking mechanism 34. The anchor mechanism 32 is operated by fluid action upon the stacked pistons 36 of the jacking mechanism 34 which initially drive slips 38 outwards. Fluid also acts on each piston 36 to move an inner mandrel 40 of the tool 12 upwards relative to a static outer body 42. Fluid to operate the hydraulic jack 30, comes from the throughbore 22, entering the actuating ports 16*a,b* through the side wall 18 formed from the inner mandrel 40. It will be appreciated that any hydraulically operated tool could be selectively operated using the resettable mechanism 10 and the hydraulic jack 30 is merely shown as a preferred embodiment.

The resettable mechanism 10, provides an inner sleeve member 24, the inner sleeve member 24 is located in the central bore 20 and is moveable relative to the downhole tool 12 between a first position closing the actuation ports 16*a,b* and a second position at which the actuation ports 16*a,b* are open to provide fluid communication between the throughbore 22 and the downhole tool 12. In this embodiment, the inner sleeve member 24 includes four access ports 26, arranged circumferentially around the inner sleeve member 24 and providing a passage for fluid through the inner sleeve member 24. In an embodiment, not shown, the access ports 26 are arranged to co-locate with the actuation ports 16 in the second position with the inner sleeve member 24 arranged against the side wall 18.

In the preferred embodiment, shown in FIG. 1, the resettable mechanism 10 also includes an intermediate sleeve 28. The intermediate sleeve 28 is arranged between the inner sleeve member 24 and the side wall 18 of the downhole tool 12. The intermediate sleeve 28 has an upper end 44 and a lower end 46 which, when positioned in the central bore 20, span the actuation ports 16*a,b,* and create a sealed chamber 48 between the intermediate sleeve 28 and the side wall 18. The intermediate sleeve 28 has intermediary ports 50, which are equal in number size and location to the access ports 26 of the inner sleeve member 24. In this way, the inner sleeve member 24 can have a reduced number of access ports 26 from the throughbore 22 than there are actuation ports 16*a,b* on the downhole tool 12. The position of the access ports 26 can also be fixed at one longitudinal position on the mechanism 10 and used with a tool 12 having actuation ports spread out longitudinally along the central bore 20.

When the access ports 26 are mis-aligned with the intermediary ports 50, the inner sleeve member 24 seals the intermediary ports closing the fluid passageway from the throughbore 22 to the chamber 48. With the chamber 48 closed fluid cannot flow into the actuation ports 16*a,b* and the downhole tool 12 cannot be actuated. When the access ports 26 are aligned with the intermediary ports 50, there is created a fluid passageway from the throughbore 22 to the chamber 48 and on into the actuation ports 16*a,b*. This is the open position and the downhole tool 12 can be actuated to operate.

The inner sleeve member 24 is biased in the open position by use of a spring 52. An upper end 54 of the inner sleeve member 24 contacts a stop 56 to restrict its upward movement. The spring 52 is located between a lower end 58 of the inner sleeve member 24 and a shoulder 60. In this biased position the access ports 26 are aligned with the intermediary ports 50.

The inner sleeve member 24 includes a ball seat 62. In this way, a ball 64 dropped down the throughbore 22 can seat in the ball seat 62 and via an increase in fluid pressure, the inner sleeve member 24 is moved against the bias spring 52 so as to mis-align the access ports 26 and the intermediary ports 50 and move the resettable mechanism 10 to the closed position. Movement is temporary, by making either the ball seat 62 or the ball 64 deformable, so that at sufficient pressure the ball 64 falls through the seat 62. The bias can then act on the inner sleeve member 24 once more to move it upwards.

A ball catcher 66 is arranged below the shoulder 60 as is known in the art, to retain the ball 64 after it has passed through the ball seat 62. In this way, multiple balls 62 can be passed down the throughbore to cause movement of the inner sleeve member 24.

Longitudinal movement of the inner sleeve member 24 is controlled by an indexing mechanism 68. The indexing mechanism 68 comprises a groove 70 arranged circumferentially on an outer surface 72 of the inner sleeve member 24. FIG. 2 illustrates the groove pattern of groove 70. The groove is continuous and provides a plurality of sequential indexing positions, the indexing positions determining the extent of longitudinal travel of the inner sleeve member 24 when the inner sleeve member 24 rotates in the central bore 20 relative to a cooperating index pin(s) 72 located in the groove 70. Pin(s) 72 is attached to the intermediate sleeve 28. With the inner sleeve member 24 biased to the open position, as shown in FIG. 1, the index pins 72 are held in lowermost pockets 74 of the groove 70, as shown in FIG. 2. On dropping a ball 64 to locate on the seat 62, the inner sleeve member 24 will move downwards relative to the intermediate sleeve 28, as fluid pressure increases on the ball 64 against the seat 62. The index pins 72 move within the groove 70 to seat in upper pockets 76. When the index pins 72 are in the upper pockets 76, the inner sleeve member 24 is prevented from further movement. Increased fluid pressure will act on the ball 64 to push it through the ball seat 62 and be retained in the ball catcher 66. This release of fluid pressure causes the spring 52 to bias the inner sleeve member 24 upwards towards the stop 56. The index pins 72 move into lower pockets 78 on the groove 70. The lower pockets 78 and a shorter distance from the upper pockets 76 than the lowermost pockets 74. A lower pocket 78 is arranged between each lowermost pocket 74 and an upper pocket 76 is arranged between every lowermost pocket 74 and lower pocket 78. With the index pins 72 in the lower pockets 78, the inner sleeve member 24 is held away from the stop 56 and has made less longitudinal travel in the central bore 20. Accordingly, the access ports 26 and the intermediary ports 50 are misaligned and the resettable mechanism 10 is in the closed position. Fluid can be flowed down the throughbore in this configuration at any desired pressure without causing actuation of the downhole tool 12. When the downhole tool 12 requires to be actuated, a ball 64 is dropped down the throughbore again to rotate the inner sleeve member 24 and move it longitudinally with the index pins 72 following the groove 70, to locate the pins 72 in the upper pockets 76. Continued pressure forces the ball 64 through the seat 62 and the inner sleeve member is then biased towards the stop 56 with the index pins 72 now in the lowermost pockets 74. The access ports 26 and the intermediary ports 50 are aligned and the resettable mechanism 10 is in the open position for fluid to travel through the ports 26,50 into chamber 48 and hence through actuation ports 16*a,b* to actuate the downhole tool 12.

By continually dropping balls 64, the hydraulically operated downhole tool 12 can selectively be operated in the well. When the resettable mechanism 10 is in the closed position, preventing actuation of the hydraulically operated downhole tool 12, fluid can be passed through the downhole tool 12 at any desired pressure and used to actuate hydraulically operated tools on the tubular string 14 below the downhole tool 12. When the ball catcher 66 is full the string 14 can be pulled out of the hole POOH, though the ball catcher will preferably be sized to hold the desired number of balls 64 to complete all required tasks in the well on a single trip.

It will be appreciated that the groove 70 in the indexing mechanism 68, may have a different groove pattern to achieve the opening and closing of the resettable mechanism 10, as can the bias on the inner sleeve member 24 be reversed.

While the resettable mechanism 10 has been described as a component part in a hydraulically operated downhole tool 12, the preferred embodiment, as shown in FIG. 1, is that the resettable mechanism 10 is provided in its own sub. Resettable mechanism sub 80 comprises a cylindrical body 82 having pin and box sections at respective first and second ends 84,86 connectable in the work string 14. The pin section 84 is preferably connected to the respective box section end of the downhole tool 12. The intermediate sleeve 28 is connected to the body 82 at the upper end 44 and the lower end 46 includes a sealing element 92, such as an o-ring, on its outer surface 94. The intermediate sleeve 28 has an extension 96 at the second end 90 sized to fit within the central bore 20 of the downhole tool 12 and for the sealing element 92 to contact the side wall 18 to thereby create the chamber 48. The extension 96 is protrudes outside the body 82 of the sub 80. The remaining elements of the inner sleeve member 24, spring 52, indexing mechanism 68 and ball catcher 66 are all arranged within the body 82 of the sub 80. The extension 96 has a length sufficient to cover all the actuation ports 16*a,b* in the downhole tool 12. In this way, the resettable mechanism 10 can be used with any hydraulically operated downhole tool without requiring modification to the downhole tool itself.

Figures 3A, 3B, 3C, 3D:
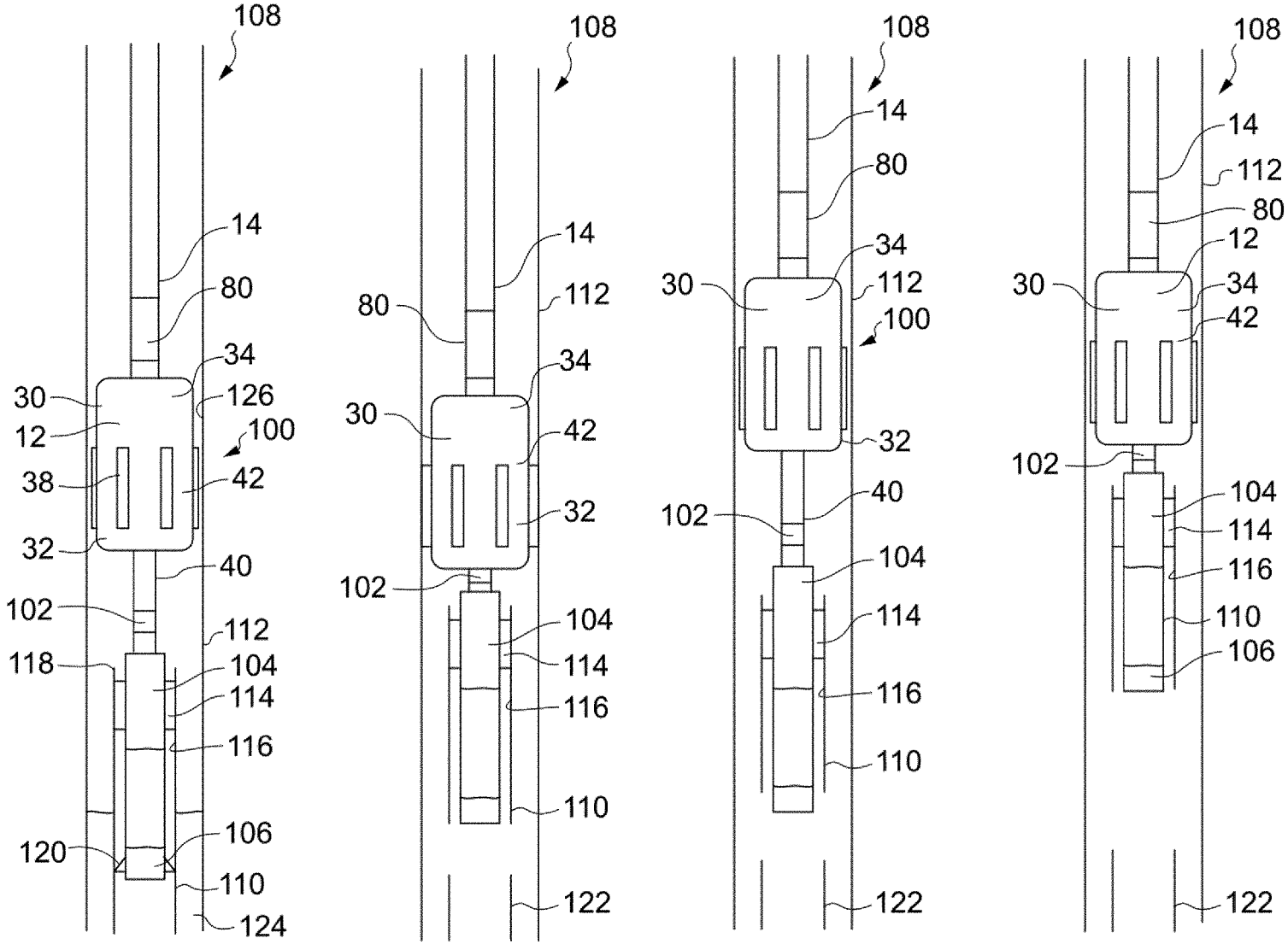
FIGS. 3(*a*)-(*d*) illustrate apparatus and method for casing recovery in a wellbore, using a downhole assembly, according to an embodiment of the present invention.

Reference is now made to FIGS. 3(*a*)-(*d*) which illustrate a method of controlled actuation of a hydraulically operated downhole tool 12 in a tubular string 14. Those parts referred to in FIGS. 1 and 2 have been given the same reference numeral. The method is described for casing recovery in a well.

The resettable mechanism 10 is formed in the sub 80 and is now part of a downhole assembly 100. The downhole assembly 100 includes the resettable mechanism sub 80 connected to the hydraulically operated downhole tool 12, which is a hydraulic jack 30. The downhole assembly 100 also includes a valve 102, a casing spear 104 and a casing cutter 108. The assembly 100 is mounted on the pipe string 14 and pipe string 14 is a drill string typically run from a rig (not shown) via a top drive/elevator system which can raise and lower the string 14 in the well 108. The casing cutter 106 and casing spear 104, which together may be referred to as a cutting and pulling tool, are run into a first casing 110 in the well 108. The well 108 has a second casing 112 in which the first casing 110 is located. In an embodiment, casing 110 is 9⅝" in diameter while the outer casing 112 is 13⅜" diameter.

The downhole assembly 100 represents a known cut, pull and jacking system for casing recovery. These are as described in the prior art section. Known cutting and pulling tools are hydraulically operated. There is thus a known disadvantage in operating a hydraulic jack and a hydraulic casing cutting and pulling tool on the same work string. When fluid flows through the string to operate the casing cutter, the hydraulic jack will also operate. Where the casing cutter requires to be stabilised to cut a circumferential slot in the casing, the operation of the anchor mechanism of the jack to grip casing in the well bore is advantageous. However, the flow also operates the jack and the resulting telescoping movement as the jack strokes will cause the cutter blades to be raised as they are contacting the casing. This can cause damage to the blades and limit the ability of the tool to make a clean and complete cut. In US2019/0162046, the stroke length is kept short, about 0.5 m and it is believed contracting the jack with blades extended and starting to rotate will simply raise the blades initially as they speed up for the length of the stroke. As long as the casing spear is not engaged then damage is considered as avoided. In WO2018083473, the casing cutter is operated at a lower pressure than the jack and the pump rate is maintained at the lower level during the cut to prevent the jack operating. Alternatively, the spear is engaged and the jack will act on the casing spear trying to raise the uncut casing section. Movement is therefore unlikely as the load is insufficient, but as soon as the cut is complete, the cut section will be raised.

For the present invention, it may be advantageous to be able to prevent the hydraulic jack from operating while the casing cutter is being used.

In a preferred embodiment the casing spear 104 comprises: a sliding assembly mounted on an inner mandrel; grippers 114 for gripping onto an inner wall 116 of the length of casing 110, the grippers 114 being coupled to the sliding assembly; the sliding assembly is operable for moving the grippers 114 between a first position in which the grippers 114 are arranged to grip onto the inner wall 116 of a length of casing 110 in at least one gripping region of the length of casing 110 and a second position in which the grippers 114 is held away from the inner wall 116; and a switcher which, when advanced into the length of casing 110, locks the sliding assembly to the inner mandrel with the grippers 114 in the second position; and, when the casing spear 104 is pulled upward out of the length of casing 110 and the switcher exits the end of the length of casing 110, automatically allows engagement of the length of casing 110 by the grippers 114 in the first position. In this way, the length of casing 110 is automatically gripped into engagement with the casing spear 104 when the casing spear 104 is at the top 118 of the length of casing 110. In a preferred embodiment the casing spear 104 is the Typhoon® Spear supplied by Ardyne AS. Other casing spears 104 exist and may be used. Such casing spears, like that described herein, are operated mechanically such as by rotation of the string 14. They may also be operated hydraulically if desired.

Casing cutter 106 may be any tool which is capable of cutting casing downhole in a well bore. A pipe cutter, section mill, jet cutter, laser cutter and chemical cutter are a non-exhaustive list of possible casing cutters. In a preferred embodiment, the casing cutter 106 comprises a plurality of blades 120 which radially extend to meet and cut the casing 110, when the casing cutter 106 is rotated. The downhole assembly 110 may include a motor to rotate the tubing string 14 between the grippers 114 of the casing spear 104 and the casing cutter 106. Thus the casing cutter 106 in the downhole assembly 100 described herein is hydraulically operated.

On run-in the resettable mechanism 10 will be arranged in the open position, with the access ports 26 and intermediate ports 50 aligned. There will be insufficient pressure in the throughbore 22 to actuate the hydraulic jack 30. Similarly, the casing spear 104 and casing cutter 106 will be deactivated.

As shown in FIG. 3(*a*) the downhole assembly 100 is run in the well. The casing spear 104 is activated by pulling the assembly out of the casing section 110 and the casing cutter 106 is held in a longitudinal position in the well 108 at the desired position to make a cut. The resettable mechanism 10 is then operated by dropping a first ball 64 through the string 14. As described hereinbefore with reference to FIGS. 1 and 2, the act of dropping the ball 64 will move the inner sleeve member 24 to cover the intermediate ports 50 and consequently the actuation ports 16*a,b* in the downhole tool 12, being the hydraulic jack 30. Fluid pumped down the throughbore 22 can then be used to operate the casing cutter 106 entirely independently from the hydraulic jack 30. The casing 110 is cut with the slips 38 of the anchor mechanism 32 in the hydraulic jack 30 being free from the casing 112 and the inner mandrel 40 of the hydraulic jack 30 remaining stationary.

This results in the casing cutter 106 being used to cut the casing 110 to separate it from the remaining casing string 122. The cut casing 110 may be over 100 m in length. It may also be over 200 m or up to 300 m. Behind the casing 110 there may be drilling fluid sediments, partial cement, sand or other settled solids in the annulus between the outside of the casing 110 and the casing 112. This material 124 can prevent the casing 110 from being free to be pulled from the well 108. With the casing 110 cut, the pipe string 14 is attempted to be raised to see if the casing spear 104 gripping the upper end 118 of the casing 110 provides sufficient loading to free the casing 110 and remove the cut section of casing 110 from the well 108. If movement doesn't occur then the hydraulic jack 30 is required.

To operate the hydraulic jack 30, a second drop ball 64 is released from surface into the throughbore 22 (though there could be a ball release sub in the string 14 above the assembly 100 if desired). The second drop ball 64 travels by fluid pressure and/or gravity to the ball valve seat 62 in the inner sleeve member 24 of the resettable mechanism 10 in the sub 80. The ball 64 when seated seals the throughbore 22 and blocks the passage of fluid through the pipe string 14 at the sub 80. By continuing to pump fluid from surface, the fluid pressure will increase above the ball 64 and cause the inner sleeve member 24 to move against the bias spring 52 and the index pins 72 in the indexing mechanism 68 move from the lower pockets 78 into the upper pockets 76. The inner sleeve member 24 is then fixed and increased pressure forces the ball 64 through the seat 62, by virtue of one or other being made of a deformable material. The inner sleeve member 24 then moves with the bias to meet the stop 56 in which the access ports 26 align with the intermediate ports 50 and provide a fluid passageway via the chamber 48 to the actuation ports 16*a,b*. The resettable mechanism 10 is thus in the open position. To operate the hydraulic jack 30, the string 14 is pulled so as to close the valve 102. Such a valve 102 which closes on this operation is described in U.S. Pat. No. 10,392,901, the contents of which are included herein by reference. However any valve which closes the throughbore 22 below the hydraulic jack 30 may be used, such as a drop ball of smaller diameter than that used with the resettable mechanism 10.

Fluid will now enter the actuation ports 16*a,b* and cause the inner mandrel 40 to move upwards relative to the body 42 of the jack 30. This initially sets the slips 38. The slips 38 may be replaced by simple pistons which move radially outward on action of fluid pressure, but in either arrangement the anchor mechanism 32 is operated to grip the inner wall 126 of the outer casing 112. With the hydraulic jack 30 held in place, fluid at the increased pressure will enter the jacking mechanism 34, through ports 16*a,b* and move the pistons 36 thereby raising the inner mandrel 40 relative to the upper pipe string 14. As the inner mandrel 40 forms a lower pipe string 14 and is connected to the casing spear 104, the cut section of casing 110 is raised. As tension is applied to the string 14, the valve 102 remains closed and maximum pressure can be applied to operate the downhole tool 12. This is as illustrated in FIG. 3(*b*).

It is hoped that the jack 30 can make a full stroke to give maximum lift to the casing 110. This is illustrated in FIG. 3(*b*). If the casing 110 is still stuck only a partial stroke will be achieved. In either case, the anchor mechanism 32 can be unset by setting down weight to open the valve 102. Fluid flow is then established back through the throughbore 22 of the entire string. This is equivalent to the run-in position with the resettable mechanism 10 remaining in the open position. The hydraulic jack 30 is repositioned by pulling on the pipe string 14 to extend the mandrel 40 from the outer housing body 42 of the jack 30.

If required the hydraulic jack 30 can be selectively switched back to the closed position by dropping a further ball 64 down the throughbore. Such a reset to a closed position on the resettable mechanism allows further actuation of tools located below the jack 30. This may be required to open the valve 102. When the jack 30, is repositioned as illustrated in FIG. 3(*c*), the valve 102 is closed again, and fluid flow is directed into the hydraulic jack 30, so as to anchor the jack to the casing 112 and operate the jack 30 as described hereinbefore with reference to FIG. 3(*b*). This will pull the cut section of casing 110 by raising the mandrel 40.

The steps are repeated until the section of casing 110 is free, wherein the pipe string 14, downhole assembly 100 and recovered casing 110 can be raised out of the well 108 as illustrated in FIG. 3(*d*).

It will be appreciated that the hydraulic jack may have actuation ports which operate the anchor mechanism independently of the jacking mechanism. In this arrangement only the actuation ports connected to the anchor mechanism need be accessed via the resettable mechanism, as the jacking mechanism operating during a cut will have no effect on the cut assuming that the casing spear is set. Additionally, it can also be assumed that the casing will not be capable of being moved until the cut is complete, the load of the entire casing string being too great. On completion of the cut, the cut section will rapidly separate and by monitoring tension on the string, the point at which the cut is complete will be signalled by a drop in tension.

The principle advantage of the present invention is that it provides a resettable mechanism and method of controlled actuation of a hydraulically operated downhole tool.

A further advantage of the present invention is that it provides a resettable mechanism to allow selective actuation of a hydraulically operated downhole tool so that a further hydraulically operated downhole tool located below the downhole tool can be independently actuated.

A still further advantage of at least one embodiment of the present invention is that it provides a casing recovery system in which the casing cutter can be operated independently of a hydraulic jack located downstream of the casing cutter on the string.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended with the invention being defined within the scope of the claims.

We claim:

1. A resettable mechanism to allow selective actuation of a hydraulically operated downhole tool in a tubular string, the hydraulically operated downhole tool including at least one actuation port through a side wall of a central bore of the downhole tool through which fluid from a throughbore of the tubular string passes to actuate the downhole tool, comprising:

an inner sleeve member, the inner sleeve member located in the central bore and being moveable relative to the downhole tool between a first position closing fluid communication to the at least one actuation port and a second position at which the at least one actuation port is open to provide fluid communication between the throughbore and the downhole tool; and an indexing mechanism coupling the inner sleeve member to the downhole tool to permit the inner sleeve member to be selectively moved between the first position and the second position and to maintain the inner sleeve member in the first or second position;

wherein the hydraulically operated downhole tool is a hydraulic jack being a downhole pulling tool comprising an anchor mechanism and a jacking mechanism.

2. The resettable mechanism according to claim 1 wherein the indexing mechanism comprises a groove arranged circumferentially on an outer surface of the inner sleeve member, the groove is continuous and provides a plurality of sequential indexing positions, the indexing positions determining the extent of longitudinal travel of the inner sleeve member when the inner sleeve member rotates in the central bore relative to a cooperating index pin located in the groove, and the inner sleeve member is biased in a first longitudinal direction.

3. The resettable mechanism according to claim 2 wherein the inner sleeve member includes a ball seat, movement of the inner sleeve member by force upon a ball seated in the ball seat moves the inner sleeve member against the bias of the indexing mechanism, and the ball is releasable from the ball seat.

4. The resettable mechanism according to claim 1 wherein the inner sleeve member comprises at least one access port, the at least one access port arranged through a wall of the inner sleeve member to co-locate with the at least one actuation port when the inner sleeve member is in the second position.

5. The resettable mechanism according to claim 1 wherein the resettable mechanism includes an intermediate sleeve, the intermediate sleeve being arranged between the inner sleeve member and the side wall of the downhole tool, the intermediate sleeve having an upper end and a lower end which, when positioned in the central bore, span the at least one actuation port and create a sealed annular chamber between the intermediate sleeve and the side wall.

6. The resettable mechanism according to claim 1 wherein the downhole tool is an anchor comprising a plurality of anchoring elements having surfaces adapted to grip a tubular surface when contacted thereupon, the anchoring elements are moved radially outwards upon action of hydraulic fluid against a surface thereof.

7. The resettable mechanism according to claim 1 wherein the jacking mechanism comprises a plurality of stacked pistons, which when actuated by fluid pressure telescope the jack so as to decrease the length and apply an upward force on a downhole object connected the jack.

8. The resettable mechanism according to claim 1 wherein the resettable mechanism is arranged to selectively actuate the anchor mechanism independently of the jacking mechanism.

9. The resettable mechanism according to claim 1 wherein the resettable mechanism selectively operates both the anchor mechanism and jacking mechanism together.

10. The resettable mechanism according to claim 1 wherein there is provided a second downhole tool, the second downhole tool also being a hydraulically operated downhole tool.

11. The resettable mechanism according to claim 10 wherein the second downhole tool is a casing cutter.

12. The resettable mechanism according to claim 10 wherein the second downhole tool is a casing cutting and pulling tool.

13. The resettable mechanism according to claim 10 wherein the second downhole tool includes a second resettable mechanism, the second resettable mechanism being operated by a drop ball of smaller diameter than the drop ball of the first resettable mechanism.

14. A method of controlled actuation of a hydraulically operated downhole tool in a tubular string, comprising the steps:

(a) mounting the hydraulically operated downhole tool in the tubular string with a resettable mechanism to selectively open and close at least one actuation port in the downhole tool;

(b) running the tubular string in a well bore;

(c) pumping fluid from surface down a throughbore of the tubular string while maintaining the resettable mechanism in a closed configuration;

(d) resetting the resettable mechanism to an open position and providing fluid communication between the throughbore and the downhole tool through the at least one actuation port; and (e) hydraulically operating the downhole tool;

wherein the hydraulically operated downhole tool is a hydraulic jack being a downhole pulling tool comprising an anchor mechanism and a jacking mechanism.

15. The method according to claim 14 wherein the steps comprise:

(a) mounting the hydraulically operated downhole tool in the tubular string with a resettable mechanism comprising:

an inner sleeve member, the inner sleeve member located in the central bore and being moveable relative to the downhole tool between a first position closing fluid communication to the at least one actuation port and a second position at which the at least one actuation port is open to provide fluid communication between the throughbore and the downhole tool; and an indexing mechanism coupling the inner sleeve member to the downhole tool to permit the inner sleeve member to be selectively moved between the first position and the second position and to maintain the inner sleeve member in the first or second position;

(b) running the tubular string in a well bore with the resettable mechanism in the first position;

(c) pumping fluid from surface down the throughbore of the tubular string while maintaining the resettable mechanism in the first position;

(d) moving the inner sleeve member between the first position and the second position via the indexing mechanism to provide fluid communication between the throughbore and the downhole tool through the at least one actuation port;

(e) hydraulically operating the downhole tool; and (f) moving the inner sleeve member from the second position to the first position via the indexing mechanism to close the at least one actuation port and prevent operation of the hydraulically operated downhole tool.

16. The method according to claim 15 wherein the method comprises repeating steps (d) to (f) to cycle operation of the hydraulically operated downhole tool.

17. The method according to claim 15 wherein steps (d) and (f) comprise dropping a ball down the throughbore of the tubular string to seat in a ball seat of the inner sleeve member and by the build-up of fluid pressure on the ball, moving the inner sleeve member against a bias.

18. A method of controlled actuation of a hydraulically operated downhole tool in a tubular string, comprising the steps:

(a) mounting the hydraulically operated downhole tool in the tubular string with a resettable mechanism to selectively open and close at least one actuation port in the downhole tool;

(b) running the tubular string in a well bore;

(c) pumping fluid from surface down a throughbore of the tubular string while maintaining the resettable mechanism in a closed configuration;

(d) resetting the resettable mechanism to an open position and providing fluid communication between the throughbore and the downhole tool through the at least one actuation port; and (e) hydraulically operating the downhole tool;

wherein the downhole tool is a hydraulic jack being part of a downhole pulling tool and at step (e) an anchor mechanism of the downhole pulling tool engages a casing in the wellbore.

19. A method of controlled actuation of a hydraulically operated downhole tool in a tubular string, comprising the steps:

(a) mounting the hydraulically operated downhole tool in the tubular string with a resettable mechanism to selectively open and close at least one actuation port in the downhole tool;

(b) running the tubular string in a well bore;

(c) pumping fluid from surface down a throughbore of the tubular string while maintaining the resettable mechanism in a closed configuration;

(d) resetting the resettable mechanism to an open position and providing fluid communication between the throughbore and the downhole tool through the at least one actuation port; and (e) hydraulically operating the downhole tool;

wherein there is a second hydraulically operated downhole tool located on the string and the method includes at step (c) operating the second hydraulically operated downhole tool in the wellbore while maintaining the first hydraulically operated downhole tool in the first position.

* * * * *